US005333560A

United States Patent [19]

Yoshida

[11] Patent Number: 5,333,560

[45] Date of Patent: Aug. 2, 1994

[54] PROGRAMMED LOCK STITCH SEWING MACHINE HAVING DISPLAY

[75] Inventor: Noriyuki Yoshida, Nagoya, Japan

[73] Assignee: Brother Kogyo Kabushiki Kaisha, Nagoya, Japan

[21] Appl. No.: 30,862

[22] Filed: Mar. 12, 1993

[30] Foreign Application Priority Data

Apr. 22, 1992 [JP] Japan ..... 4-102727

[51] Int. Cl.[5] ..... D05B 19/00; D05B 57/08

[52] U.S. Cl. ..... 112/121.11; 112/181; 112/445; 112/458

[58] Field of Search ..... 112/121.11, 121.12, 112/445, 458, 262.1, 266.1, 453, 181, 184, 182, 183

[56] References Cited

U.S. PATENT DOCUMENTS 4,901,656 2/1990 Yoshida et al. ..... 112/445 X
5,097,779 3/1992 Ishikawa et al. ..... 112/445
5,099,777 3/1992 Mori ..... 112/445

FOREIGN PATENT DOCUMENTS 2-75074 6/1990 Japan .

*Primary Examiner*—Peter Nerbun
*Attorney, Agent, or Firm*—Oliff & Berridge

[57] ABSTRACT

A lock stitch machine that has a liquid crystal display screen capable of displaying pages respectively containing choices, instruction messages and guidance messages; a display controller for controlling the liquid crystal display according to the operation of control switches to display a desired page and to permit the selection of a desired choice contained in the displayed page; a task selection switch for selecting one of the choices contained in the page displayed on the liquid crystal display; and a page scrolling switch for scrolling the pages displayed on the liquid crystal display. The pages displayed on the liquid crystal display are scrolled sequentially by operating the page scrolling switch, and choices including kinds of workpieces, types of seams and kind of work contained in the pages are selected by operating the task selection switch. If trouble occurs, a troubleshooting page containing measures to eliminate the trouble can be displayed on the liquid crystal display. Thus, most operations for operating the lock stitch machine can be carried out without consulting the operation manual.

5 Claims, 15 Drawing Sheets

```
<WORKPIECE DESIGNATION>  OPERATE THE SELECTOR KEY TO SPECIFY THE
                         WORKPIECE

[CHOICES]        ◇1<AVERAGE FABRIC>
                 ◇2<STRETCHABLE, AVERAGE FABRIC>
                 ◇3<THIN FABRIC>
                 ◇4<STRETCHABLE, THIN FABRIC>
                 ◇5<THICK FABRIC>
                 ◇6<STRETCHABLE, THICK FABRIC>

*    PRESS THE ROLL-DOWN KEY TO DISPLAY THE NEXT PAGE
```

```
[MESSAGE]

     <THIN FABRICS>
          GEORGETTE
          CREPE DE CHINE
          LAWN CLOTH
          BROAD CLOTH

*    PRESS THE M KEY TO RETURN TO THE PREVIOUS PAGE
```

Fig.3

```
【FUNCTIONS OF KEYS】      *     ↓ KEY ---- PAGES ARE ROLLED DOWN
                           *     ↑ KEY ---- PAGES ARE ROLLED UP
                           *     ◆ KEY ---- CHOICE IS SELECTED
                           *     M KEY ---- MESSAGE IS DISPLAYED

*    OPERATE THE SELECTOR KEY TO SELECT A CHOICE
     【CHOICES】      ◇1<WORKPIECE DESIGNATION>
                      ◇2<TROUBLESHOOTING>

*    PRESS THE ROLL-DOWN KEY TO DISPLAY THE NEXT PAGE
```

Fig.4

```
<WORKPIECE DESIGNATION>  OPERATE THE SELECTOR KEY TO SPECIFY THE
                         WORKPIECE

[CHOICES]                ◇1<AVERAGE FABRIC>
                         ◇2<STRETCHABLE, AVERAGE FABRIC>
                         ◇3<THIN FABRIC>
                         ◇4<STRETCHABLE, THIN FABRIC>
                         ◇5<THICK FABRIC>
                         ◇6<STRETCHABLE, THICK FABRIC>

*    PRESS THE ROLL-DOWN KEY TO DISPLAY THE NEXT PAGE
```

Fig.5

```
                                        *  WORKPIECE: <THIN FABRIC>
<SEAM DESIGNATION>  OPERATE THE SELECTION KEY TO DESIGNATE SEAMS

【CHOICES】
     ◇1<OVERLOCK SEAM AND PLAIN SEAM (FIVE-THREAD)>
     ◇2<OVERLOCK SEAM AND PLAIN SEAM (FOUR-THREAD)>
     ◇3<OVERLOCK SEAM (THREE-THREAD)>
     ◇4<PLAIN SEAM>
     ◇5<TAPPING SEAM>
     ◇6<NARROW LOCK STITCH SEAM>
     ◇7<WHIP STITCH SEAM>
     ◇8<OVERLOCK SEAM>
     ◇9<FLAT LOCK SEAM>

*    PRESS THE ROLL-DOWN KEY TO DISPLAY THE NEXT PAGE
```

Fig.6

```
          *    WORKPIECE:  <THIN FABRIC>
          *    SEAM: <OVERLOCK SEAM AND PLAIN SEAM (FIVE-THREAD)>

【NEEDLES】
     1:  RIGHT NEEDLE ---- Nm 70 NEEDLE
     2:  LEFT NEEDLE  ---- NONE
     3:  FRONT NEEDLE ---- #11 NEEDLE

*    PRESS THE ROLL-DOWN KEY TO DISPLAY THE NEXT PAGE
```

Fig.7

```
        *    WORKPIECE:  <THIN FABRIC>
        *    SEAM: <OVERLOCK SEAM AND PLAIN SEAM (FIVE-THREAD)>

【LOOPER YARNS】
     TYPE:  SPUN YARNS
     THREADING ORDER:  GREEN → BLUE → PURPLE

*    PRESS THE ROLL-DOWN KEY TO DISPLAY THE NEXT PAGE
```

Fig.8

```
*     WORKPIECE:  <THIN FABRIC>
*     SEAM: <OVERLOCK SEAM AND PLAIN SEAM (FIVE-THREAD)>

【NEEDLE THREADS】
     TYPE:  SPUN YARNS
     THREADING ORDER:  RED → YELLOW

*    PRESS THE ROLL-DOWN KEY TO DISPLAY THE NEXT PAGE
```

Fig.9

```
          *    WORKPIECE:  <THIN FABRIC>
          *    SEAM: <OVERLOCK SEAM AND PLAIN SEAM (FIVE-THREAD)>

【TENSION DIALS】
     TENSION DIAL 1:  3
     TENSION DIAL 2:  3
     TENSION DIAL 3:  4
     TENSION DIAL 4:  4

*    PRESS THE ROLL-DOWN KEY TO DISPLAY THE NEXT PAGE
```

Fig.10

```
*    WORKPIECE:  <THIN FABRIC>
*    SEAM: <OVERLOCK SEAM AND PLAIN SEAM (FIVE-THREAD)>

【FEED DIAL】                          ---- 3
【OVERLOCK SEAM WIDTH DIAL】           ---- 5
【DIFFERENTIAL FEED RATIO DIAL】       ---- 1.0

*    PRESS THE ROLL-DOWN KEY TO DISPLAY THE NEXT PAGE
```

Fig.11

```
          *    WORKPIECE:  <THIN FABRIC>
          *    SEAM: <OVERLOCK SEAM AND PLAIN SEAM (FIVE-THREAD)>

*     OPEN THE FRONT COVER AND OPERATE THE KNOBS
      【STITCH TONGUE】                  ---- LEFT POSITION
      【TWIN NEEDLE STITCH LEVER】       ---- UPPER POSITION

【TYPE OF PRESSER FOOT】          ---- LR PRESSER FOOT

*     PRESS THE ROLL-DOWN KEY TO DISPLAY THE NEXT PAGE
```

Fig.12

```
            *    WORKPIECE:  <THIN FABRIC>
            *    SEAM: <OVERLOCK SEAM AND PLAIN SEAM (FIVE-THREAD)>

*     OPEN THE HEAD COVER AND SET THE CUTTING DEVICE
      【MOVABLE BLADE】                ---- UPPER POSITION
*     OPEN THE FRONT COVER AND TURN THE SCREWS WITH A SCREW DRIVER
      【CUTTER COVER】                 ---- POSITION A
      【DOUBLE CHAIN STITCH SCREW】  ---- TURN THE SCREW CLOCKWISE TO
                                          A STOP

*     PRESS THE ROLL-DOWN KEY TO DISPLAY THE NEXT PAGE
```

Fig.13

```
*     WORKPIECE:  <THIN FABRIC>
*     SEAM: <OVERLOCK SEAM AND PLAIN SEAM (FIVE-THREAD)>

【TRIAL SEWING】
     PULL ALL THE THREADS TO THE LEFT SIDE OF THE PRESSER FOOT
     BEFORE STARTING THE MACHINE

*    IF TRIAL SEWING IS UNSATISFACTORY, PRESS THE ROLL-DOWN KEY TO
     DISPLAY THE FIRST PAGE AND SELECT ◇2 <TROUBLESHOOTING>

*    PRESS THE ROLL-DOWN KEY TO DISPLAY THE NEXT PAGE
```

Fig.14

```
<TROUBLESHOOTING>   OPERATE THE SELECT KEY TO SELECT THE TOPIC
                    TROUBLE

【CHOICES】
     ◇ 1<SKIP STITCHES>
     ◇ 2<INADEQUATE TENSION>
     ◇ 3<THREAD BREAKAGE>
     ◇ 4<CREASING IN THE FEED DIRECTION>
     ◇ 5<CREASING IN THE OVERLOCKING DIRECTION>
     ◇ 6<FABRIC IS STRETCHED>
     ◇ 7<FABRIC IS NOT FED>
     ◇ 8<NEEDLE BREAKAGE>
     ◇ 9<FABRIC IS DISLOCATED>
     ◇10<NOISE>

*    PRESS THE ROLL-DOWN KEY TO DISPLAY THE NEXT PAGE
```

Fig.15

【MESSAGE】

<THIN FABRICS>
GEORGETTE
CREPE DE CHINE
LAWN CLOTH
BROAD CLOTH

* PRESS THE M KEY TO RETURN TO THE PREVIOUS PAGE

PROGRAMMED LOCK STITCH SEWING MACHINE HAVING DISPLAY

BACKGROUND OF THE INVENTION

1. Field of the Invention

The invention relates to a lock stitch machine capable of stitching various kinds of overlock seams selected according to the type of workpiece.

2. Description of Related Art

When setting a lock stitch machine for sewing a workpiece, the operator is required to determine, through consulting an operation manual, many sewing conditions including tension of needle thread, tension of bobbin thread, feed, differential feed ratio, type of throat plate and type of presser foot according to the kind of fabric and the type of seam. Such a sewing condition setting procedure is troublesome.

A lock stitch machine intended to eliminate the troublesome sewing conditions setting procedure is disclosed in Japanese Utility Model Laid-open No. Hei 2-75074. This known lock stitch machine is provided with a liquid crystal display and a seam type selector switch on its arm. The machine displays one of the possible seam types together with all the necessary sewing conditions suitable for the seam type, including tension of the needle thread, tension of the bobbin thread, feed, differential feed ratio, type of throat plate and type of presser foot. Every time the seam type selector switch is operated, another seam type and the sewing conditions suitable for the selected seam type are displayed on the liquid crystal display.

Since a desired seam type and all the suitable sewing conditions can be displayed on the liquid crystal display simply by operating the seam type selector switch, the sewing conditions can be observed and the lock stitch machine can be set for forming the seam of the selected seam type without consulting the operation manual, thereby improving time and effort involved in setting the appropriate sewing conditions.

However, the sewing conditions need to be expressed by abridged sentences and the sentences need to be displayed in a close arrangement on the liquid crystal display to display all of the sewing conditions. Such a manner of display makes viewing and understanding the sewing conditions difficult and, in some cases, the operator needs to consult the operation manual to understand the meaning of the abridged sentences displayed on the liquid crystal display. Moreover, if the procedure of operating the lock stitch machine cannot be understood or a trouble occurs during the sewing operation, the operator needs to perform various troubleshooting operations, including consulting the operation manual which also is troublesome.

SUMMARY OF THE PRESENT INVENTION

Accordingly, it is an object of the invention to provide a lock stitch machine capable of explicitly and easily recognizably displaying seam types and sewing conditions, of enabling operation without consulting the operation manual when the procedure of operation cannot be understood, of enabling taking measures for troubleshooting problems without consulting the operation manual, and of facilitating the operation of the lock stitch machine.

In one aspect of the invention, a lock stitch machine comprises: a display means provided with a display screen for displaying choices including kinds of work and kinds of workpieces, instruction messages and guidance messages explaining necessary procedures; a display control means for presenting a plurality of pages respectively containing the choices, the instruction messages and the guidance messages, and selecting one of the plurality of pages to display the selected page on the display means; a selecting means for selecting a desired choice from among those contained in the page displayed on the display means; and a page scrolling means for scrolling the pages displayed on the display means.

Since one of the plurality of pages is displayed selectively on the display screen of the display means, a comparatively small number of items are displayed at a time on the display screen. This facilitates understanding of the contents of the items displayed on the display screen. Since the choices and the instruction messages or the guidance messages are displayed in the plurality of pages, an operating procedure can be readily understood from a page indicating a relevant instruction message providing the operating procedure. In the case where a trouble occurs during the sewing operation, measures for troubleshooting can be found in a page indicating guidance messages for troubleshooting. Thus, the invention makes consulting the operation manual rarely necessary and greatly improves the ease of use of the lock stitch machine.

BRIEF DESCRIPTION OF THE DRAWINGS

The above and other objects, features and advantages of the invention will become more apparent from the following description taken in connection with the accompanying drawings, in which:

FIG. 3 is a first page displayed on a display screen;

FIG. 4 is a second page displayed on the display screen;

FIG. 5 is a third page displayed on the display screen;

FIG. 6 is a fourth page displayed on the display screen;

FIG. 7 is a fifth page displayed on the display screen;

FIG. 8 is a sixth page displayed on the display screen;

FIG. 9 is a seventh page displayed on the display screen;

FIG. 10 is an eighth page displayed on the display screen;

FIG. 11 is a ninth page displayed on the display screen;

FIG. 12 is a tenth page displayed on the display screen;

FIG. 13 is an eleventh page displayed on the display screen;

FIG. 14 is a twelfth page displayed on the display screen; and

FIG. 15 is a thirteenth page displayed on the display screen.

DESCRIPTION OF THE PREFERRED EMBODIMENTS

Figure 2:
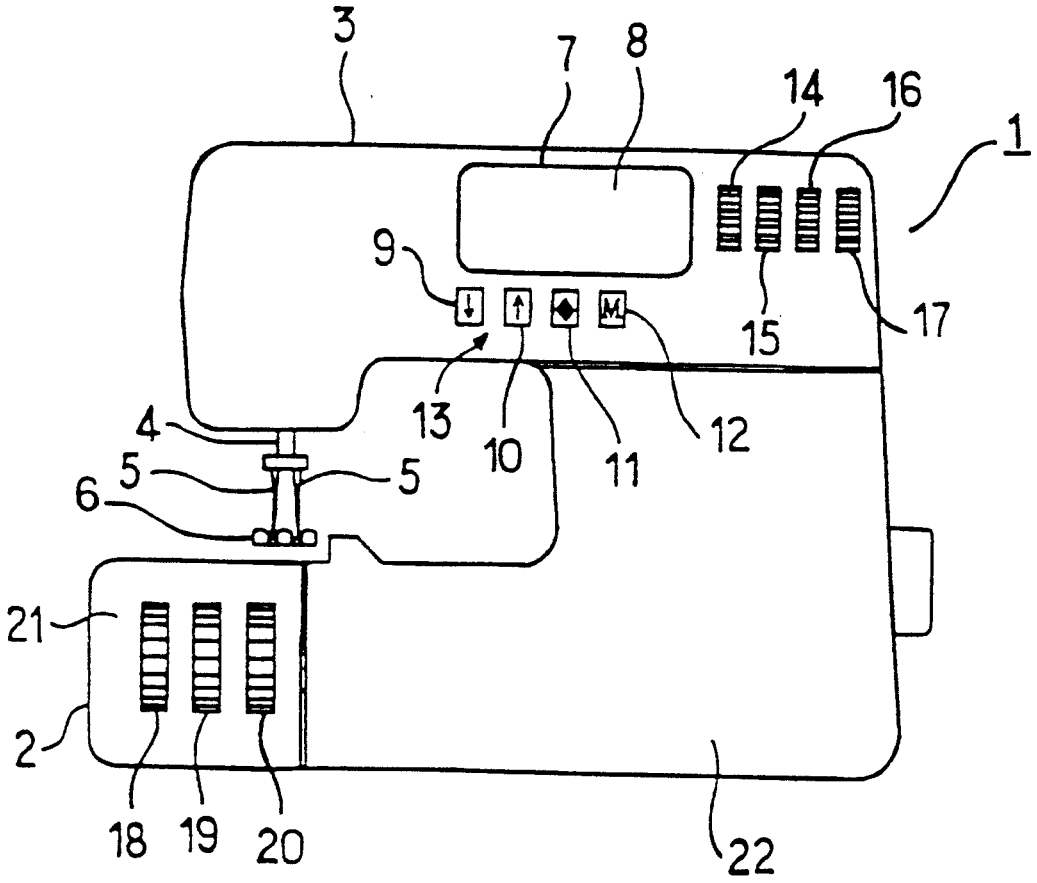
FIG. 2 is a schematic front view of the lock stitch machine.

Referring to FIG. 2, a machine body 1 consists of a bed unit 2 and an arm unit 3. A needle bar 4 is supported for vertical reciprocation on the left end (as viewed in FIG. 2) of the arm unit 3, and, for example, two needles 5 are attached to the lower end of the needle bar 4.

Loopers, not shown, i.e., loop arresters, are supported, for rocking motion synchronous with the vertical reciprocation of the needle bar 4, within the bed unit 2. A feed dog, not shown, is supported, for feed motion synchronous with the vertical reciprocation of the needle bar 4, on the bed unit 2. A cutting device, not shown, for cutting a workpiece, i.e., a fabric, is disposed in the bed unit 2. A throat plate, not shown, is supported on the left end of the bed unit 2 at a position directly under the needle bar 4. A presser bar, not shown, holding a presser foot 6 at its lower end is supported for vertical movement behind the needle bar 4 on the arm unit 3.

A liquid crystal display 7 having a display screen 8 is provided on the front surface of the middle portion of the arm unit 3. Choices including kind of seam and kind of workpiece, instruction messages or guidance messages are displayed on the display screen 8.

A roll-down switch 9, a roll-up switch 10, a task selection switch 11 and a help switch 12 are arranged under the liquid crystal display 7. A page selecting unit 13 comprises the roll-down switch 9 and the roll-up switch 10. The roll-down switch 9 is operated to move from a page currently displayed on the display screen 8 of the liquid crystal display 7 to display the next page. The roll-up switch 10 is operated to move from the page currently displayed on the display screen 8 of the liquid crystal display 7 to display the preceding page.

The task selection switch 11 is operated to select a desired choice displayed on the display screen 8 of the liquid crystal display 7. The help switch 12 is operated to display a message describing data displayed on the display screen 8 of the liquid crystal display 7.

Four tension adjusting dials 14, 15, 16 and 17 are arranged on the front surface of the right end portion of the arm unit 3. The tension adjusting dials 14 to 17 are operated to adjust the respective tensions of the corresponding threads. A feed adjusting dial 18, a hemming seam width adjusting dial 19 and a differential feed ratio adjusting dial 20 are arranged on the front surface of the left end portion of the bed unit 2. The dials 18 to 20 are covered with a transparent cover 21. Feed, hemming seam width and differential feed ratio are adjusted by means of the feed adjusting dial 18, the hemming seam width adjusting dial 19 and the differential feed ratio adjusting dial 20, respectively.

The front opening of the bed unit 2 and the front opening of the vertical portion of the arm unit 3 are covered with a cover 22, which can be opened. Sewing condition setting mechanisms and various types of presser feet and needles, which are used selectively according to the seam type, are contained in cavities covered by the cover 22.

Figure 1:
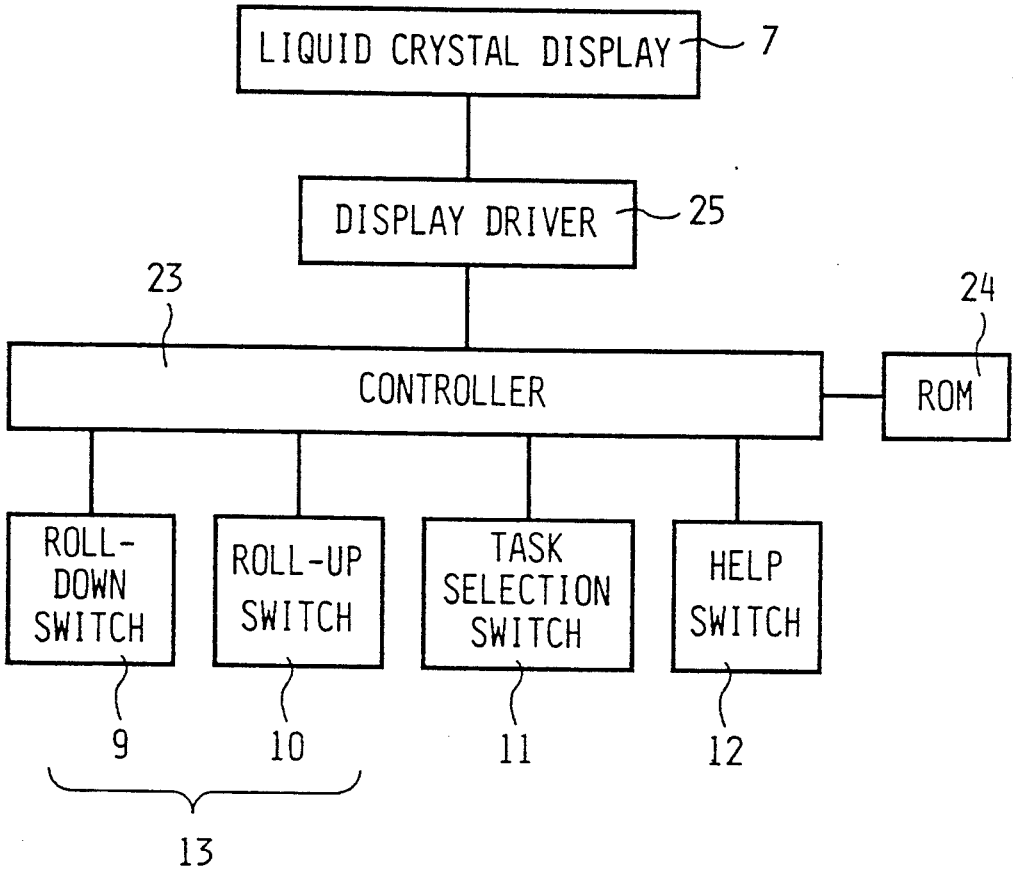
FIG. 1 is a block diagram of an instruction display system incorporated into a lock stitch machine in a preferred embodiment according to the invention.

Referring to FIG. 1, showing the electric system, a controller 23, i.e., a display control means, comprises a microcomputer and executes control programs, for controlling the operation of the lock stitch machine, stored in a ROM 24. Also stored in the ROM 24 are data to be displayed on the liquid crystal display 7, including choices, such as type of seam and type of workpiece, instruction messages specifying operating procedures, and guidance messages.

The controller 23 receives signals provided by operating the roll-down switch 9, the roll-up switch 10, the task selection switch 11 and the help switch 12 and sends a control signal to a display driver 25 for driving the liquid crystal display according to the control signal. The controller 23 edits a plurality of pages for displaying the choices, the instruction messages or the guidance messages and selects one of the pages for display on the display screen 8 of the liquid crystal display 7. The controller 23 also controls the operation of a main motor, not shown, to control the sewing operation of the lock stitch machine.

The operation of the lock stitch machine thus structured will be described hereinafter with reference to FIGS. 3 to 15.

Upon the connection of the lock stitch machine to a power source, a first or main page, shown in FIG. 3, is displayed on the display screen 8 of the liquid crystal display 7. The main page includes messages indicating the respective functions of the switches 9 to 12, and two choices, namely, choice 1: "Workpiece Designation" and choice 2: "Troubleshooting". The task selection switch 11 is operated to select the choice 1 or the choice 2. When the choice is selected, a blank rhombic mark at the head of the choice changes into a solid rhombic mark.

Suppose that the choice 1: "Workpiece Designation" is selected. When the roll-down switch 9 is operated, a second page indicating different kinds of workpieces, shown in FIG. 4, is displayed on the display screen 8. The second page includes a message prompting the selection of the kind of workpiece, and six kinds of workpieces. Then, the task selection switch 11 is used to select the kind of workpiece to be sewn on the lock stitch machine. When the task selection switch 11 is operated repeatedly, the choices are selected sequentially one at time from the choice indicated by the smallest identification number toward the choice indicated by the largest identification number. A blank rhombic mark at the head of the selected choice changes into a solid rhombic mark.

Suppose that the choice 3: "Thin fabric" is selected. When the roll-down switch 9 is operated, a third page, i.e., a seam type menu, shown in FIG. 5, is displayed on the display screen 8. The third page contains a message prompting the selection of a seam type and lists nine seam types. When the task selection switch 11 is operated repeatedly, the choices are selected sequentially one at a time from the choice indicated by the smallest identification number toward the choice indicated by the largest identification number. A blank rhombic mark at the head of the selected choice changes into a solid rhombic mark.

Suppose that the choice 1: "Overlock seam and plain seam (Five-thread)" is selected. Then, the roll-down switch 9 is operated to display a fourth page, as shown in FIG. 6, on the display screen 8. The fourth page indicates the types of needles and a procedure for attaching the needles to the needle bar. The designated needles are attached to the needle bar by the procedure shown on the fourth page.

The roll-down switch 9 is then operated to display a fifth page, shown in FIG. 7, on the display screen 8. The fifth page indicates types of looper threads and the procedure for threading the looper threads. The loopers are threaded with the designated looper threads by the procedure shown in the fifth page.

The roll-down switch 9 is operated to display a sixth page, shown in FIG. 8, on the display screen 8. The sixth page indicates the types of needle threads and the procedure for threading the needles with the needle threads. The needles are threaded with the designated needle threads by the procedure shown on the sixth page.

The roll-down switch 9 is operated to display a seventh page as shown in FIG. 9. The seventh page indicates a procedure of setting optimum tensions (recommended tensions) for the threads. The tension setting dials 14 to 17 are turned the designated amount according to the procedure shown in the seventh page to set the threads in the designated tensions, respectively.

Then, the roll-down switch 9 is operated to display an eighth page, shown in FIG. 10. The eighth page contains messages designating optimum values, i.e., values recommended by the maker for feed, overlock seam width and differential feed ratio. The feed dial 18, the overlock seam dial 19 and the differential feed dial 20 are adjusted to set the feed, overlock seam width and differential feed ratio to the values designated by the messages.

The roll-down switch 9 is operated to display a ninth page, shown in FIG. 11. The ninth page indicates the position for the stitch tongue, the position for the twin needle stitch lever and the type of presser foot. The stitch tongue and the twin needle stitch lever are set, respectively, at the designated positions and the designated presser foot is attached to the presser bar.

Then, the roll-down switch 9 is operated to display a tenth page, shown in FIG. 12, on the display screen 8. The tenth page contains instruction messages designating positions for the movable blade of the cutting device and the cutter cover and the manner of setting the screw for double chain seam. The movable blade of the cutting device and the cutter cover are set at the designated positions and the screw for the double chain seam is fastened according to the instruction.

Then, the roll-down switch 9 is operated to display an eleventh page as shown in FIG. 13. The eleventh page provides instruction messages for trial sewing. Trial sewing is carried out according to the instruction messages.

The roll-down switch 9 is then operated to display the first page shown in FIG. 3. If trial sewing has been unsuccessful, the task selection switch 11 is operated to select the choice 2: "Troubleshooting". Then, the roll-down switch 9 is operated to display a twelfth page, shown in FIG. 14 indicating categories of troubles. The relevant choice from among those shown on the twelfth page is selected and the roll-down switch 9 is operated to display messages on the display screen 8, not shown, explaining troubleshooting procedures. If necessary, the roll-down switch 9 is operated repeatedly to display measures to deal with the trouble and troubleshooting measures are sequentially displayed on the display screen 8. The lock stitch machine is adjusted according to the messages displayed on the display screen 8 to eliminate the trouble and, then, the sewing operation is started.

Although steps of operation to set the lock stitch machine for the choice 3: "Thin fabric" and the choice 1: "Overlock seam and plain seam (Five-thread)" have been explained by way of the example, the steps of operation to set the lock stitch machine for other choices are substantially the same as those explained above.

If the contents of the messages or the data contained in the pages shown in FIGS. 3 to 13 are unintelligible, messages fully explaining the contents of the messages and the data can be displayed on the display screen 8 by operating the help switch 12. For example, if the help switch 12 is operated with the second page displayed on the display screen 8 and the choice 3: "Thin fabric" selected, a thirteenth page, shown in FIG. 15 and indicating the various kinds of thin fabrics, is displayed on the display screen 8. The help switch 12 is operated again with the thirteenth page displayed on the display screen 8, to return to the previous page, i.e., the second page, shown in FIG. 4, in this example.

When the roll-up switch 10 is operated with any one of the pages of FIGS. 4 to 14 displayed on the display screen 8, the display returns to the preceding page, that is, for example the second page of FIG. 4 is changed to the first page of FIG. 3, the eleventh page of FIG. 13 is changed to the tenth page of FIG. 12, or the twelfth page of FIG. 14 is changed to the first page of FIG. 3.

Since the plurality of pages are displayed one at a time on the display screen 8, each page contains a relatively small number of messages and hence the contents of the messages are easily understood. Since a plurality of pages relevant to the guide messages are available, the procedure for operating the lock stitch machine can be easily understood from the page containing an instruction message explaining the procedure.

If a trouble occurs, measures to deal with the trouble can be found in the page containing guidance messages relevant to the trouble topic. Accordingly, most operations can be performed without consulting the operation manual, which improves the usability of the lock stitch machine.

The procedures for operating the lock stitch machine can be correctly carried out by simply following the instruction messages contained in the pages which are displayed sequentially on the display screen 8.

Further, the lock stitch machine may be provided with an audio response system to present the topic message with speech in addition to displaying the page containing the topic message on the display screen 8 of the liquid crystal display 7. The audio response system will further facilitate understanding of the contents of the messages and will further improve the usability of the lock stitch machine.

Although the invention has been described in its preferred form with a certain degree of particularity, obviously many changes and variations are possible therein. It is therefore to be understood that the invention may be practiced otherwise than as specifically described herein without departing from the scope and spirit thereof.

What is claimed is:

1. A lock stitch machine for sewing seams, comprising:

a sewing needle;

a read only memory storing data including types of seams, kinds of workpieces, operating instructions, troubleshooting, and help data;

display means having a display screen for displaying the data as choices including types of seams and kinds of workpieces, operating instruction messages providing machine settings for selected types of seams and kinds of workpieces, troubleshooting choices of potential malfunctions, instructional messages for explaining procedures to overcome the malfunctions, and explanation messages as help messages explaining an immediately preceding displayed screen, said malfunctions including a seam trouble and a machine trouble;

display control means for presenting a plurality of pages respectively containing the choices, the operating instruction messages, the troubleshooting choices and instructional messages, and the explanation messages, wherein a one of said plurality of pages is displayed on said display screen;

a help switch for immediately displaying the explanation messages upon activation as help messages;

selecting means for selecting one of the choices contained in the choice page displayed on the display means; and page scrolling means for scrolling the pages displayed on the display means, said scrolled pages being presented by said display control means in sequence based upon the selected choice.

2. An automated instruction manual and a lock stitch machine, comprising:

a sewing needle;

a display screen on the lock stitch machine;

a read only memory containing control programs and data for a plurality of screen displays;

control means for executing the control programs to include a program for the display of a one of said plurality of screen displays;

selection means for selecting among choices presented on at least one of said screen displays;

a help switch for immediately displaying an explanation screen upon activation concerning a currently displayed screen; and page scrolling means for moving a current screen display to a one of an immediately preceding display screen and an immediately following display screen, wherein said plurality of display screens includes screens for presenting choices, screens for providing instructions, and the screens for providing explanations as help messages for an immediately preceding display screen, said screens for presenting choices including screens that present seam types and workpiece types.

3. The automated instruction manual and lock stitch sewing machine as claimed in claim 2, wherein said selection means comprises a selection switch, each activation of which causes a different choice to be designated on a screen for presenting choices.

4. The automated instruction manual and lock stitch sewing machine as claimed in claim 3, wherein activating said page scrolling means for moving to the immediately following screen initiates display of a screen based upon the designated choice.

5. The automated instruction manual and lock stitch sewing machine as claimed in claim 2, wherein said page scrolling means comprises a roll-up switch for instructing movement from the current screen display to the immediately preceding screen display and a roll down switch for instructing movement to the immediately following display screen.

* * * * *